US006616378B2

(12) United States Patent
Turner et al.

(10) Patent No.: US 6,616,378 B2
(45) Date of Patent: Sep. 9, 2003

(54) DEVICE AND METHOD FOR STORING AND PROTECTING DATA RELATING TO PIPE INSTALLATION

(75) Inventors: Simon Charles Coote Turner, Ipswich (GB); Martin David Warner, Ely (GB)

(73) Assignee: Staploe Limited, Suffolk (GB)

( * ) Notice: Subject to any disclaimer, the term of this patent is extended or adjusted under 35 U.S.C. 154(b) by 0 days.

(21) Appl. No.: 09/794,124

(22) Filed: Feb. 27, 2001

(65) Prior Publication Data

US 2001/0024597 A1 Sep. 27, 2001

(30) Foreign Application Priority Data

Mar. 2, 2000 (GB) ..... 0004957

(51) Int. Cl.[7] ..... F16L 1/00; B65H 59/00

(52) U.S. Cl. ..... 405/154.1; 405/160; 405/174; 405/175; 405/184; 340/668; 254/134 FT

(58) Field of Search ..... 405/154.1, 157, 405/158, 160, 174, 175, 177, 183.5, 184, 184.1; 175/40, 53; 340/539, 665, 668, 679; 73/862.392, 862.391, 862.42, 862.44; 254/134.3 FT, 270; 702/187, 138, 6.9

(56) References Cited

U.S. PATENT DOCUMENTS

| | | | | | |
|---|---|---|---|---|---|
| 4,461,459 | A | * | 7/1984 | Conti | 254/134.3 FT |
| 4,475,591 | A | * | 10/1984 | Cooke, Jr. | 73/155.51 X |
| 4,502,666 | A | * | 3/1985 | Mattelon et al. | 254/134.3 FT |
| 4,565,351 | A | * | 1/1986 | Conti et al. | 254/134.3 FT |
| 4,628,747 | A | * | 12/1986 | Weitz et al. | 73/862.44 |
| 4,692,063 | A | * | 9/1987 | Conti | 405/177 |
| 4,728,079 | A | * | 3/1988 | Nitta et al. | 254/134.3 FT |
| 4,974,168 | A | * | 11/1990 | Marx | 73/622 X |
| RE33,793 | E | * | 1/1992 | Cherrington et al. | 175/53 X |
| 5,132,904 | A | | 7/1992 | Lamp | |
| 5,163,520 | A | | 11/1992 | Gibson | |
| 5,294,923 | A | * | 3/1994 | Juergens et al. | 175/40 X |
| 5,516,080 | A | * | 5/1996 | McVaugh | 254/134.3 FT |
| 5,725,059 | A | * | 3/1998 | Kuckes et al. | 175/45 |
| 5,807,026 | A | * | 9/1998 | Valette | 405/158 |
| 5,812,068 | A | * | 9/1998 | Wisler et al. | 340/855.5 |
| 5,833,015 | A | * | 11/1998 | Hesse et al. | 175/40 |
| 6,105,437 | A | * | 8/2000 | Klug et al. | 73/756 |
| 6,105,690 | A | * | 8/2000 | Biglin, Jr. et al. | 475/48 |
| 6,109,832 | A | * | 8/2000 | Lincoln | 405/184 |
| 6,193,218 | B1 | * | 2/2001 | Philyaw | 254/134.3 FT |
| 6,262,941 | B1 | * | 7/2001 | Naville | 175/40 X |

FOREIGN PATENT DOCUMENTS

| | | | | |
|---|---|---|---|---|
| DE | 29921308.0 | | 12/1999 | |
| DE | 10016948 | A1 | 11/2000 | |
| EP | 0799969 | A2 | 10/1997 | |
| FR | 2614795 | * | 11/1988 | 340/668 |

* cited by examiner

*Primary Examiner*—Jong-Suk (James) Lee
(74) *Attorney, Agent, or Firm*—Barnes & Thornburg

(57) ABSTRACT

A device (6) for attachment to a pipe (7) to be installed in the ground has load cells (17) for detecting a pulling force applied to the pipe (7), as the latter is pulled through the ground, an inclinometer (18), for detecting the inclination of the device (6), and a pressure transducer (20) for detecting the pressure surrounding the device. Data representative of the pulling force, inclination and pressure is stored in the device (6) and protected against unauthorised access by a security code or procedure, so that a verifiable record of the pipe installation process is available.

9 Claims, 3 Drawing Sheets

DEVICE AND METHOD FOR STORING AND PROTECTING DATA RELATING TO PIPE INSTALLATION

FIELD OF THE INVENTION

This invention relates to pipe installation, and in particular to a device for attachment to a pipe being installed underground and to a method of installing a pipe by the use of such a device. The term pipe is to be construed herein as covering cables as well as tubular pipes.

BACKGROUND OF THE INVENTION

There are two main ways of installing pipes underground by trenchless methods, namely directional drilling and swage lining. Directional drilling is commonly used to install pipes under areas such as roads, rivers, airport runways or environmentally sensitive sites where it is not appropriate to dig trenches. A rotating drill is used to advance a drill pipe, extendable in sections, so that the drill pipe forms a pilot hole and follows a desired path underground between a launch area and a target area. At the target area, a cutter is attached to the end of the drill pipe. Behind the cutter is a swivel to Which is attached the pipe to be installed. The drill pipe is then pulled back through the pilot hole, the rotating cutter enlarging the pilot hole as it goes. As the drill pipe is pulled back through the pilot hole, the pipe to be installed is pulled through the enlarged hole from the target area to the launch area. Swage lining involves squeezing a plastics pipe between rollers in order temporarily to reduce its diameter and then pulling (by winch and cable) the pre-squeezed pipe through an existing damaged or faulty pipe or through an existing bore.

In both these methods there are two main problems. The first is ensuring that the magnitude of the pulling force applied to the pipe is not excessive and, in particular, that the pulling force does not stretch the pipe beyond its elastic limit. The second is to ensure that a verifiable record is available of the variation of pulling force during the installation process. In tile absence of proper verification, it is possible for data relating to pulling force to be tampered with. The invention aims to solve both of these problems.

SUMMARY OF THE INVENTION

According o one aspect of the invention there is provided a device for attachment to a pipe to be installed in the ground, the device having tensile force detector means for detecting a pulling force applied to the pipe as the latter is pulled through the ground, storage means for storing data representative of the detected tensile force, with the stored data being protected against unauthorised access by a security code or procedure, and access means for enabling the data to be subsequently retrieved by use of the security code or procedure. Thus, a device according to the invention not only detects the pulling force but stores it in a way which enables the data to be accessed and verified as being authentic and correct. The attachment of the device to the pipe to be installed may be direct or indirect, the requirement being that the device is subjected to the tensile force applied to the pipe to be installed.

The device preferably has an inclinometer for detecting the inclination of the device as the latter is pulled through the ground, the storage means then additionally storing data representative of the detected inclination, this data also being protected by the security/verification code. The device may have pressure detector means for detecting the pressure surrounding the device as the latter is pulled through the ground, the storage means then additionally storing data representative of the detected pressure, the security/verification code also protecting this data.

The device may be associated with a telemetry system for transmitting the data to the ground surface. For example, the device may have a socket for connection of hard wiring for transmitting the data to the surface. Such a device may have releasable clamping means for clamping the device to one end of a pipe to be installed. Alternatively, the device may have a transmitter for transmitting the data by radio to a receiver outside the device, and the receiver may be on the ground surface but is prefereferably located in the pipe to be installed, the receiver being linked by hard wiring passing through the pipe to an antenna positioned above ground. This antenna may be positioned at or near the reception area where the pipe to be installed is fed into the ground. The antenna mail communication with a receiver positioned at or adjacent the launch area where a drilling rig is employed to pull the drill pipe, the device and the pipe to be installed through the ground.

The access means may be a socket or port on the device, enabling the stored data to be downloaded with verification code, e.g. into a personal computer, after the device is retrieved from the ground. However access to the data is dependent on the security code or procedure being used.

The invention includes within its scope a pipe installation system comprising a device according to the invention in combination with a drilling rig having means for recording data generated during installation of the pipe, the data generated by the drilling rig and the data generated by the device being combined to provide a customer report including the precise route along which the pipe has been laid.

According to another aspect of the invention there is provided a method of installing a pipe underground, comprising using a detector to detect a tensile force applied to the pipe as the latter is pulled through the ground and storing in the detector data representative of the detected pulling force, the stored data being protected against unauthorised access by a security code or procedure, ready for subsequent retrieval of the data by use of the security code or procedure.

The detector may also detect the inclination of the device and store this data representative of the inclination, and may also detect the pressure surrounding the device and store this data, in both cases this further data being protected by the security code or procedure.

BRIEF DESCRIPTION OF THE DRAWINGS

The invention will now be further described, by way of example, with reference to the accompanying drawings in which.

DETAILED DESCRIPTION OF THE INVENTION

Figure 1:
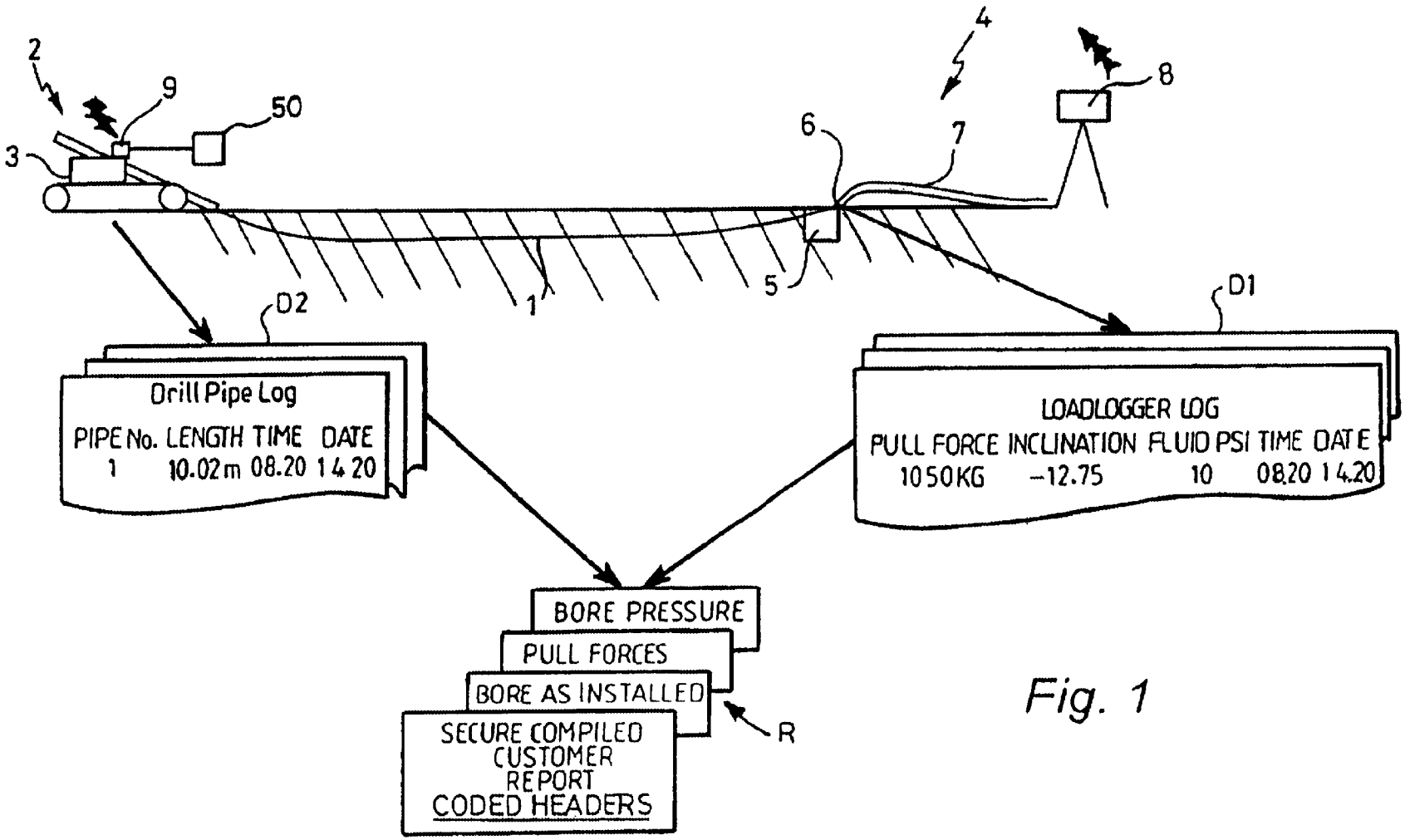
FIG. 1 is a diagram illustrating the use of a device according to the invention.

FIG. 1 illustrates a pipe installation system being used to install or lay a pipe underground by means of directional drilling. In FIG. 1 a drill pipe 1 has been thrust through the ground to form a pilot hole extending from a launch pit at a location 2 (at which a drilling rig is positioned) and a target location 4 at which a reception pit 5 has been dug. A monitoring device 6 according to the invention is attached between the end of the drill pipe 1 and the end of the pipe 7 to be installed. The rig 3 then applies to the drill pipe 1 a pulling force which draws the pipe 1 back through the pilot hole which is enlarged by a cutter (on the end of the drill pipe) as pulling takes place. For purposes to be described, a short-range radio transmitter 8 is sited at the location 4. The transmitter 8 transmits data by radio to a receiver 9 at the location 2 where an operative can view the data on a display. The transmitted data is also stored in means 50 for recording data generated during the installation of the pipe.

Figure 2:
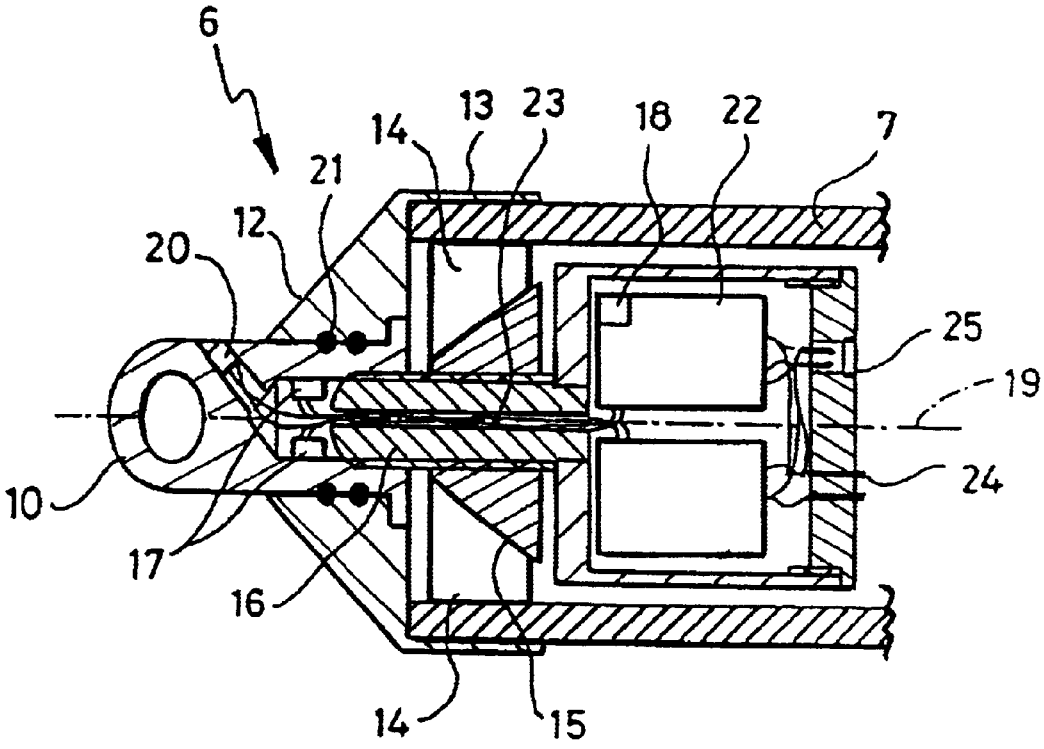
FIG. 2 is a sectional view through one embodiment of a device according to the invention.

FIG. 2 shows, in diagrammatic cross-section, one embodiment of the monitoring device 6 anchored in one end of the pipe 7. The device 6 has at one end a shackle 10 for attachment to a rotating cutter on the end of the pipe 1. The shackle 10 projects from a tapering frusto-conical wall 12 which, at its radially outer edge, adjoins a cylindrical sleeve 13. Within this sleeve 13, there is disposed an expandable gripper comprising a plurality of segments 14 each having an angled face engaging an expander cone 15 threaded on a central stem 16. Relative rotation in one direction between the expander cone 15 and the stem 16 causes the segments 14 to move radially outwardly towards the sleeve 13 and thus to clamp the end of the pipe 7 between the segments 14 and the sleeve 13. Relative rotation in the other direction releases the clamping action and enables the device 6 to be separated from the end of the pipe 7. The device 6 includes two load cells 17 (in the form of strain gauges) to detect the tensile pulling force applied to the shackle 10 and thus the force applied to the end of the pipe 7. Also, an inclinometer 18 detects the angle of inclination of the device 6, i.e. the angle with respect to the horizontal of the central axis 19 of the device. A pressure transducer 20 is let into a side bore formed in the device, in this case in an angled bore formed in the shackle 10. The shackle 10 is rotatable with respect to the remainder of the device, the interface being sealed by O-rings 21, so that the rotation of the cutter and shackle 10 is not transmitted to the pipe 7.

The load cells 17, inclinometer 18 and pressure transducer 20 are powered by a power supply within an electronics module 22 which accommodates a rechargeable battery pack and data storage means for storing data developed by the load cells 17, the inclinometer 18 and the pressure transducer 20. The measured data is sampled at predetermined time intervals (e.g. every second) and is converted from analogue to digital form in which it is stored. The stem 16 has a hollow central bore through which passes wiring 23 linking the load cells 17 and the pressure transducer 20 with the electronics module 22.

At the end remote from the shackle 10, the device 6 has a sealed output socket 24 for the reception of a plug fixed at one end of a cable which extends through the pipe 7 to the opposite cable end which is connected to the transmitter 8 at the location 4. A further port on the device serves as a security sealed connection port for linking to a personal computer, when the device is retrieved and is located above ground.

In use, the device of FIG. 1 is clamped to the end of the pipe 7 by the expander segments 14 and the cutter at the end of the drilling pipe 1 is attached to the shackle 10, these operations being performed in the reception pit 5. The rig 3 is then operated to rotate and pull the drill pipe 1 which, in turn, applies a tensile force to the shackle 10 and to the end of the pipe 7 which is thus drawn, without rotation, through the bore hole towards the location 2. The tapering wall 12 protects the leading end of the pipe 7 as it is pulled through the bore hole. During this installation process, the magnitude of the tensile force applied to the pipe 7, as detected by the load cells 17, is sampled and stored in the data storage means in the electronics module 22. Also stored therein is data representative of the inclination of the device 6 and data representative of the pressure in the region surrounding the device 6. All this data is stored in a protected manner, that is it is protected against unauthorized access by ensuring that the data can be read only by use of a security code or procedure known only to unauthorized personnel.

In addition to being stored in the storage means of the device 6, these three pieces of data are conducted to the transmitter 8 and the data is transmitted therefrom to the receiver 9 which thus receives these three categories of data in real time, i.e. as the events happen. This enables an operative at the location 2 to undertake any control or remedial action, such as reducing the tensile force applied by the rig 3 to the drill pipe 1 if the detected tensile force applied to the pipe 7 approaches or exceeds a particular threshold.

After the pipe 7 has been pulled through the hole, the shackle 10 is detached from the end of the pipe 1 and the device 6 is detached from the pipe 7 by releasing the gripper segments 14. Subsequently, the data stored in the storage means is read out of the security port 25, for example by plugging a PC lead into the security port 25. However, the data is not accessible without knowledge of a security code or password which ensures that the data read out of the storage means is authentic and the subsequent data/printouts verified by a unique code header, ensuring that the data is not edited after download. Thus, referring to FIG. 1, the data D1 read out of the device 6 can be used, with the data D2 generated during the advance of the drill pipe 1, to provide a customer report R which gives a complete history of the magnitude of the pulling force during installation, the complete history of the inclination of the device and the complete history of the pressure surrounding the device. From the data D1 and D2, the precise route along which the pipe 7 has actually been laid can be determined and it can be verified that the pipe 7 has not been subjected to a tensile force in excess of any limit, such as its elastic limit. The correct installation of the pipe along its complete length, can be verified and, when combined, with GPS data, the location of the launch pit and reception pit can be determined.

The device of FIG. 2 is suitable for loads from 10 to 50 tonnes with an accuracy of 1 kg per tonne, and detects bore inclination to an accuracy of 0.001 degrees and bore pressure up to 2000 psi. The device produces a secure and independently verifiable report, swish a real time display at the rig.

Figure 3:
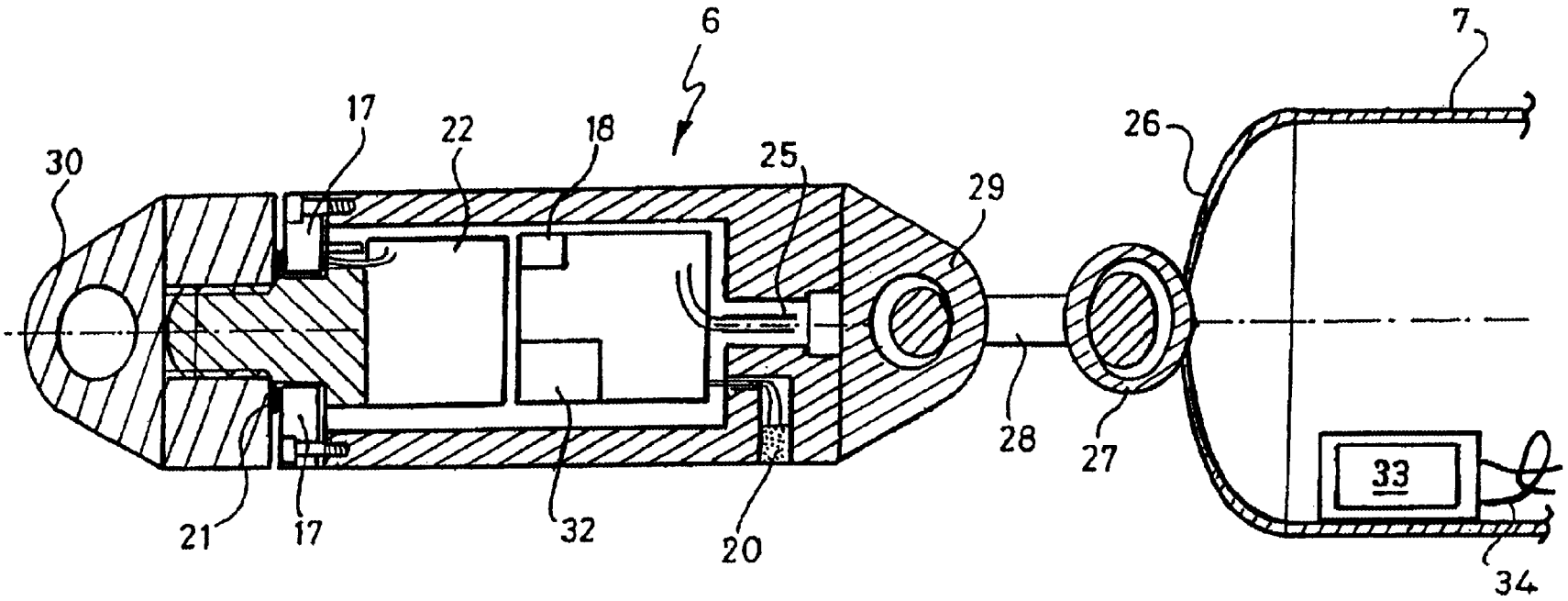
FIG. 3 is a sectional view through another embodiment of a device according to the invention.

In FIG. 3, tile leading end of the pipe to be installed 7 has fitted thereto an end cap 26 with a towing eye 27 to which the inventive device 6 is attached by a link 28 and shackle 29. Another shackle 30 at the front end of the device is in use attached to the cutter or; the end of the drill pipe 1. The shackle 30 is rotatable with respect to the remainder of the device, the interface being sealed by O-rings 21. As before, this prevents the rotation of the pipe 1 and cutter being transmitted to the pipe 7 as the latter is pulled through the bore.

The device 6 of FIG. 3 has an outer cylindrical casing housing load cells 17, an inclinometer 18 and a pressure transducer 20 corresponding to those described with reference to FIG. 2. The device 6 of FIG. 3 also has an electronics module 22 With data storage means for storing data representative of tensile force inclination to the horizontal and pressure, together with a port 25 for secure downloading of this data to a PC, as previously described. However, the device 6 of FIG. 3 carries an on-board transmitter 32 which transmits this data by a radio link to a receiver 33 located in the end of the pipe 7. From the receiver 33, the data is conducted by a cable 34 to the aerial of the transmitter 8 which transmits the data by radio to the receiver 9.

The device of FIG. 3 is suitable for loads from 10 to 100 tonnes with an accuracy of 1 kg/tonne, and detects bore inclination to an accuracy of 0.001 degree and bore pressure up to 200 psi. From data D1 and D2 the device 6 of FIG. 3 produces a secure and independently verifiable report R, with a real-time display at the rig.

A device according to the invention may be used to install a pipe underground by directional drilling or swage lining.

In the description of FIGS. 2 and 3, the shackle 10 or 30 has been described as being connected to a cutter at the end of the pipe 1. Such a cutter (or expander) is necessary if the pipe 7 is larger than the pilot bore. If the pipe 7 is not larger than the pilot bore, it may be possible to dispense with the cutter, in which case the shackle 10 or 30 is connected directly to the end of the pipe 1.

What is claimed is:

1. A device for attachment to a pipe to be installed in the ground, the device having tensile force detector means for detecting a pulling force applied to the pipe as the pipe is pulled through the ground, storage means for storing data representative of the detected pulling force, with the stored data being protected against unauthorized access by a security code or procedure, access means for enabling the data to be subsequently retrieved by use of the security code or procedure, and pressure detector means for detecting the pressure surrounding the device as the pipe is pulled through the ground, the storage means additionally storing data representative of the detected pressure, the security code or procedure also protecting the stored data.

2. A device according to claim 1, wherein the device has an inclinometer for detecting the inclination of the device as the pipe is pulled through the ground, the storage means additionally storing data representative of the detected inclination, the stored data also being protected by the security code or procedure.

3. A device according to claim 1, wherein the device has a socket for connection of hard wiring for transmitting the data to the ground surface.

4. A device according to claim 1, wherein the device ear a transmitter for transmitter for the data by radio to a receiver outside the device.

5. A device according to claim 1, wherein the device has releasable clamping means for clamping the device to one end of the pipe to be installed.

6. A device according to claim 1, wherein the access means is a socket or port on the device, enabling the stored data to be downloaded with verification code after the device is retrieved from the ground.

7. A device for attachment to a pipe to be installed in the ground, the device having tensile force detector means for detecting a pulling force applied to the pipe as the pipe is pulled through the ground, storage means for storing data representative of the detected pulling force, with the stored data being protected against unauthorized access by a security code or procedure, and access means for enabling the data to be subsequently retrieved by use of the security code or procedure and a drilling rig having means for recording data generated during installation of the pipe, the data generated by the drilling rig and the data generated by the device being combined to provide a customer report including the precise route along which the pipe has been laid.

8. A method of installing a pipe underground, comprising using a detector to detect a tensile force applied to the pipe as the pipe is pulled through the ground and storing in the detector data representative of the detected pulling force, the stored data being protected against unauthorised access by a security code or procedure, ready for subsequent retrieval of the stored data by use of the security code or procedure, detecting the pressure surrounding the device as the pipe is pulled through the ground, and additionally storing data representative of the detected pressure.

9. A method according to claim 8, including detecting inclination of the device and storing data representative of the inclination, and detecting the pressure surrounding the device and storing data representative of the pressure, all said data being protected by the security code or procedure and being retrieved by recourse to the security code or procedure.

* * * * *